US005974295A

United States Patent [19]

De Niel et al.

[11] Patent Number: 5,974,295

[45] Date of Patent: Oct. 26, 1999

[54] HEAT AND PRESSURE FUSING DEVICE

[75] Inventors: Marc De Niel, Hove; Serge Tavernier, Lint; Bart Diels, Oud-Turnhout; Luc Van Aken, Kuringen, all of Belgium

[73] Assignee: Agfa-Gevaert, Mortsel, Belgium

[21] Appl. No.: 09/035,529

[22] Filed: Mar. 5, 1998

[30] Foreign Application Priority Data

Mar. 14, 1997 [EP] European Pat. Off. ..... 97200778

[51] Int. Cl.[6] ..... G03G 15/20

[52] U.S. Cl. ..... 399/333; 399/328

[58] Field of Search ..... 399/320, 321, 399/324, 325, 328, 330, 331, 333, 334; 430/109, 111, 114

[56] References Cited

U.S. PATENT DOCUMENTS

| | | | |
|---|---|---|---|
| 4,853,311 | 8/1989 | Tavernier et al. | 430/109 X |
| 4,943,831 | 7/1990 | Geraets et al. | 399/328 X |
| 5,023,464 | 6/1991 | Mitsuya et al. | 399/330 X |
| 5,319,430 | 6/1994 | DeBolt et al. | 399/331 X |
| 5,345,301 | 9/1994 | Satoh et al. | 399/330 |
| 5,450,183 | 9/1995 | O'Leary | 399/321 |
| 5,481,349 | 1/1996 | Satoh et al. . | |
| 5,500,722 | 3/1996 | Jacobs | 399/328 |
| 5,641,603 | 6/1997 | Yamazaki et al. | 430/109 X |
| 5,689,789 | 11/1997 | Moser | 399/331 |
| 5,708,951 | 1/1998 | Saito et al. | 399/333 |
| 5,804,351 | 9/1998 | Takano et al. | 430/111 |

FOREIGN PATENT DOCUMENTS

| | | |
|---|---|---|
| 8129313 | 5/1996 | Japan . |
| 2236076 | 3/1991 | United Kingdom . |

*Primary Examiner*—Sandra Brase
*Attorney, Agent, or Firm*—Baker & Botts, L.L.P.

[57] ABSTRACT

A heat and pressure fusing device (10) for fixing toner images to a receptor support, the device having a fixing (12) and a pressure (13) roller rotating in contact with each other, wherein the fixing roller has a diameter larger than 70 mm.

11 Claims, 2 Drawing Sheets

HEAT AND PRESSURE FUSING DEVICE

FIELD OF THE INVENTION

The present invention relates to a heat and pressure fusing device for fixing multilayer toner images to a receptor support, in particular for the fixing of electrophotographic colour images.

BACKGROUND OF THE INVENTION

In electrophotographic printing, a toner image which has been transferred onto a receptor support, such as paper or plastic film, must be fixed in order to yield a useable image.

In a method using thermal energy, a toner image formed on a receptor support is melted by heating so as to adhere to the support, and for this purpose the toner image is generally pressed by a roller heated-up to the temperature at which the material composing the toner becomes adhesive. When the receptor support is paper, the toner is tightly fixed to the paper since the toner is melted and part of the toner is absorbed into the fibres of the paper.

A heat and pressure fusing device for fixing a toner image as described, comprises a fixing roller and a pressure roller in contact therewith, the receptor support having a toner image on it being passed between the nip of said rollers to fix the toner.

Inside the fixing roller, there is usually provided a heater which is switched on and off, or which is modulated in response to the output signal of a temperature sensor measuring the surface temperature of the roller, in order to obtain a reasonably constant surface temperature of said roller.

The fixing roller generally is a roller composed of a cylindrical metallic tube of aluminium or the like which is covered with a resilient layer, e.g. a layer of silicone rubber. The resilient layer may be a one-layer construction, but often this resilient layer is composed of a relatively thick inner layer of rubber comprising filler agents increasing the thermal conductivity thereof, and a thin outer layer having releasing characteristics for the receptor support in contact therewith. The fixing roller is rotatably mounted and driven by suitable motor means at a speed corresponding with the speed at which the toner image has been formed on the receptor support, but which may also differ therefrom. The pressure roller may have the same construction as the fixing roller but may also differ therefrom, e.g. by the thickness of its resilient layer, the composition thereof, the amount of its heating, its diameter, etc.

The nip between both rollers, more exactly between the resilient coverings of these rollers, is in fact the area where heat and pressure produce the fusing and thus the fixing of the toner image of a support conveyed between the rollers.

Whereas the fixing of black-and-white single layer toner images does not raise major problems in practice, the fixing of colour images is more difficult since in fact four superimposed toner colour separation images have to be fixed (Y, M, C and K) and this increased amount of toner requires a longer fusing time demanding a nip with a larger length (i.e. the dimension l of the nip measured in the transport direction of the support), unless the fusing speed is proportionally reduced.

A longer nip requires resilient layers on the rollers of increased thickness, but this raises a problem. Silicone rubbers (and similar materials) have a low thermal conductivity and therefore the surface temperature of the fixing roller largely varies with the passing-through of the receptor support because there is not sufficient time available for the heater of the fixing roller to compensate for the temperature drop of the roller surface caused by the contact with the support sheet being at room temperature. Even sophisticated temperature control systems are hardly capable of maintaining the surface temperature of common fixing rollers within acceptable limits. As a result image characteristics such as colouring, density and gloss vary whereby consistent image qualities are difficult to obtain.

Another disadvantage of a fixing roller having a resilient covering with increased thickness in order to obtain a nip with sufficient length l, is the reduction in lifetime of such covering caused by its increased deformation in the nip.

OBJECTS OF THE INVENTION

It is one object of the invention to provide an improved heat and pressure fusing device which allows to obtain a smaller ripple of the surface temperature of a fixing roller, at a given fixing speed.

It is a further object of the invention to provide a fusing device in which the resilient layer of the fixing roller is less subject to wear by contact with the leading edge of each receptor support, than with known fixing rollers, so that the lifetime of the fixing roller may be increased.

STATEMENT OF THE INVENTION

In accordance with the present invention, a heat and pressure fusing device for fixing multilayer toner images to a receptor support, said device having a fixing and a pressing roller rotating in contact with each other, at least one of the rollers acting as a heating roller, both said rollers having a resilient covering which by the pressure between both rollers forms a heating nip, is characterised in that the diameter of at least the fixing roller is larger than the one for which the reduction in temperature ripple of the peripheral roller surface of said roller, is smaller than 10° C. per 10 mm increase of roller diameter, measured at a fixing speed of 95 $mm.s^{-1}$ and for a paper receptor with a weight of 100 $g.m^{-2}$ and a oisture content in the range of 40% to 60% relative humidity.

The mentioning of a reference fixing speed of 100 $mm.s^{-1}$ is based on the fact that this value can be considered as a good average of the fixing speed of colour electrophotographic printers known in the art. The same consideration counts for the mentioned paper weight of 100 $g.m^{-2}$.

The term "receptor support" as used in the present description stands for sheets as well as for webs. The webs can be used in their actual form but can also be cut after fixing to allow stacking of sheets cut therefrom. A fixed support may be the end-product as such but it may also form an intermediate step in a production process, e.g. it may be used, after a suitable treatment, as a so-called transfer element, e.g. as a printing plate for printing images by planographic printing techniques onto a final support.

The term "multilayer toner images" covers colour printing which comprises four superimposed toner images as mentioned already, but also two or more black-and-white layers having a different grey density, and/or a combination of such layers with a transparent layer.

Suitable embodiments of a fusing device according to the invention are as follows.

The diameter of a fixing roller in a fusing device according to the present invention is relatively large, as compared with the diameter of known fixing rollers. This has the advantage that the curvature of the peripheral covering is relatively small, so that a limited impression of this covering allows to obtain a nip with a relatively large length 1. Such lengths are in the present specification lengths larger than 8 mm approximately, whereby satisfactory fusing may be obtained at fixing speeds over 95 $mm.s^{-1}$.

The thickness of the resilient covering may be at least 1.5 mm.

The impression of the resilient covering may be less than 0.5 mm.

The shore hardness of the resilient roller covering may be at least 40 Shore.

The pressure roller co-operating with the fixing roller may operate as a fixing roller as well so that in fact a symmetric arrangement is obtained which is suited for the fixing of colour duplex images, or of two colour simplex images simultaneously, the rearsides of their supports being in contact with each other. The latter technique is disclosed in our co-pending European patent application No. 96 20 3558 filed on Dec. 16, 1996, which deals with the production of simplex colour prints by means of a duplex colour printer wherein a fixing device comprising two identical fixing rollers for the fixing of two simplex prints simultaneously, thereby doubling the production rate of the machine. A fusing device according to the present invention may comprise means for treating the surface of the fixing roller for an easier release of a fixed support. Such release may form a difficulty since a reduced curvature of a fixing roller has for consequence that a fixed receptor support adhering thereto may have less tendency to become separated from such roller, under the influence of its inherent stiffness, than from a roller with a smaller diameter as common in the art. Stripping of a fixed support may occur by means of oil applied to the fixing roller, but also by means of mechanical or pneumatic systems, all as known in the art.

The present invention also includes a heat and pressure fusing device for fixing multilayer toner images to a receptor support, said device having a fixing and a pressing roller rotating in contact with each other, at least one of the rollers acting as a heating roller, both said rollers having a resilient covering which by the pressure between both rollers forms a heating nip, which device is characterised in that the diameter of at least the fixing roller is larger than 70 mm.

Finally, the invention also encompasses a heat and pressure fusing device in accordance with the statements hereinbefore, wherein the multilayer toner images have been produced by means of a toner comprising toner particles:

having a viscosity $\eta$ such that 200 Pa.s<$\eta$<2000 Pa.s, the viscosity being measured in a plate/plate rheometer at 120° C. and at a velocity of 100 $revolutions.s^{-1}$, a size in $\mu$m such that 6 $\mu m < d_{v50} < 12$ $\mu$m $d_{v50}$ being the average diameter of the toner particles expressed in $\mu$m, and comprising an amount of colouring agent such that depositing an amount TM of toner particles following the formula $$TM \leqq 0.8x\ d_{vSO} \times \rho$$

wherein TM is expressed in $mg/cm^2$, $d_{v50}$ is the average volume diameter of the toner particles expressed in cm, and $\rho$ is the bulk density of the toner particles in $mg/cm^3$, yields maximum optical density.

BRIEF DESCRIPTION OF THE DRAWINGS

The invention will be described hereinafter by way of example with reference to the accompanying drawings, wherein.

DETAILED DESCRIPTION OF THE INVENTION

Figure 1:
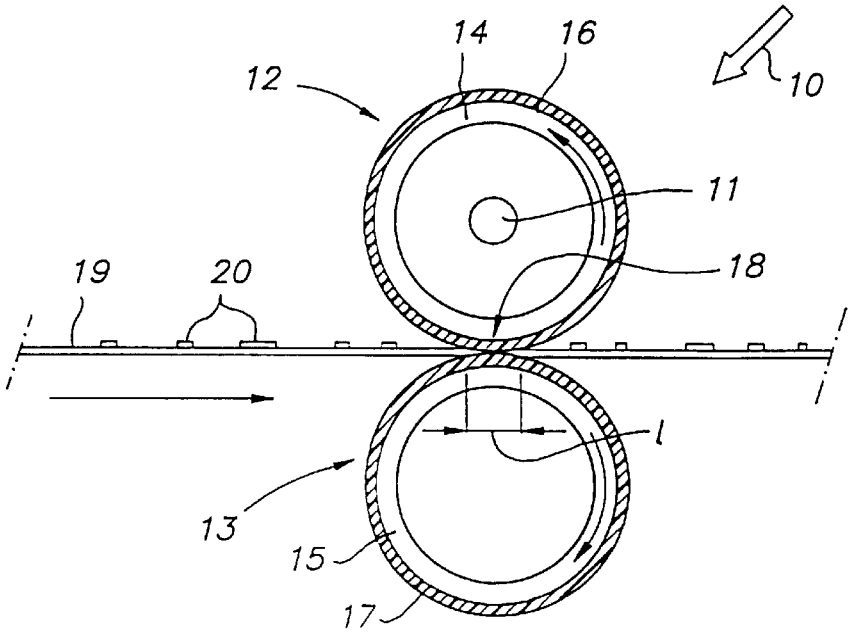
FIG. 1 is a diagrammatic view of a heat and pressure fusing device.

FIG. 1 shows one embodiment of a heat and pressure fusing device 10 which comprises a pair of rollers 12 and 13. The rollers consist of cylindrical aluminium tubes 14, resp. 15 having equal diameters, and which are mounted for rotation about their axis by means known in the art, and which are provided on their circumferential surface with a resilient covering 16 and 17, respectively, comprising filling agents for increasing the thermal conductivity thereof. The resilient covering may occasionally be coated with a layer of pure, unfilled silicone rubber or with a fluorocarbon rubber such as Viton (Registered Tradename of Dupont) or the like.

Either one or both of the rollers 12 and 13 may be provided with an internal heating device 11 such as a tubular infrared lamp.

Appropriate pressure is applied to the rollers to form a nip 18 with a length l through which a paper sheet 19 having a toner image 20 deposited thereon is passed for fixing the toner to the support.

In the vicinity of rollers 12 and 13 there may be provided means for coating inhibitor solution onto the rollers for toner off-set prevention and/or for causing an easy release of a sheet from the rollers. In addition, stripping means may be provided for ensuring a reliable release of the sheet from roller 12. Occasionally, there may be provided an auxiliary heating roller supported for engagement with roller 12 which operates as a fixing roller. Said auxiliary roller may have its own heating device for providing thermal support for the fixing roller if the temperature thereof would tend to fall below a lower limit. A heating control system is provided (not shown) comprising a sensor for measuring the surface temperature of the fixing roller, for controlling the supply current of heater 11.

Figure 2:
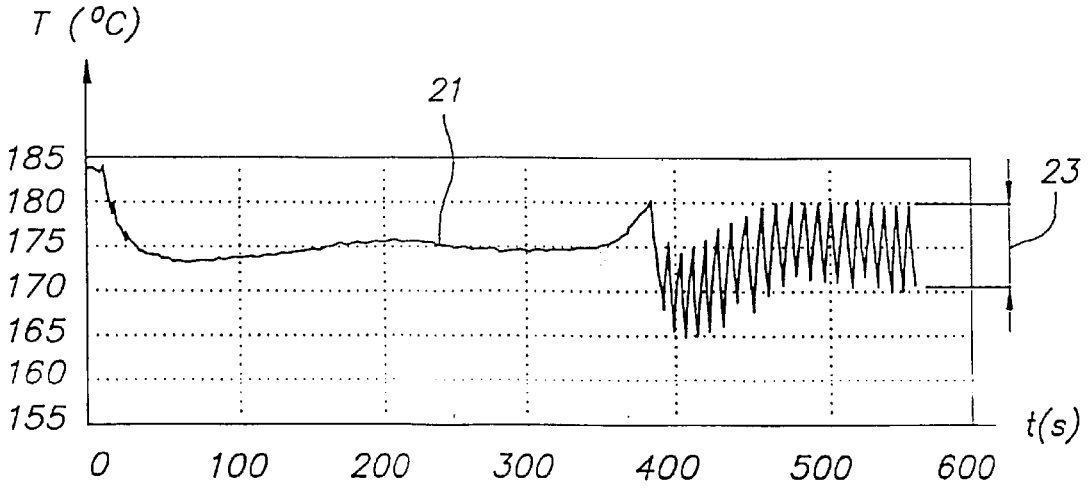
FIG. 2 shows the temperature ripple which is typical for a prior art fusing device.

FIG. 2 shows a temperature curve 21 which is typical for a prior art fixing device as shown in FIG. 1. On this curve the surface temperature T of a fixing roller 12 with a diameter of 60 mm, a covering of silicone rubber with a thickness of 2.5 mm, and heated by an axially disposed tubular heater with a nominal power of 20 W/cm roller length is plotted as a function of time t. Fixing occurred at a speed of 95 $mm.s^{-1}$. The nip formed with an opposed pressure roller having a covering of 1 mm thickness had a length l of 6 mm. The sheet throughput was 8.6 A3 $sheets.min^{-1}$. It may be seen that temperature ripple 23 amounts to 10° C. approximately.

Figure 3:
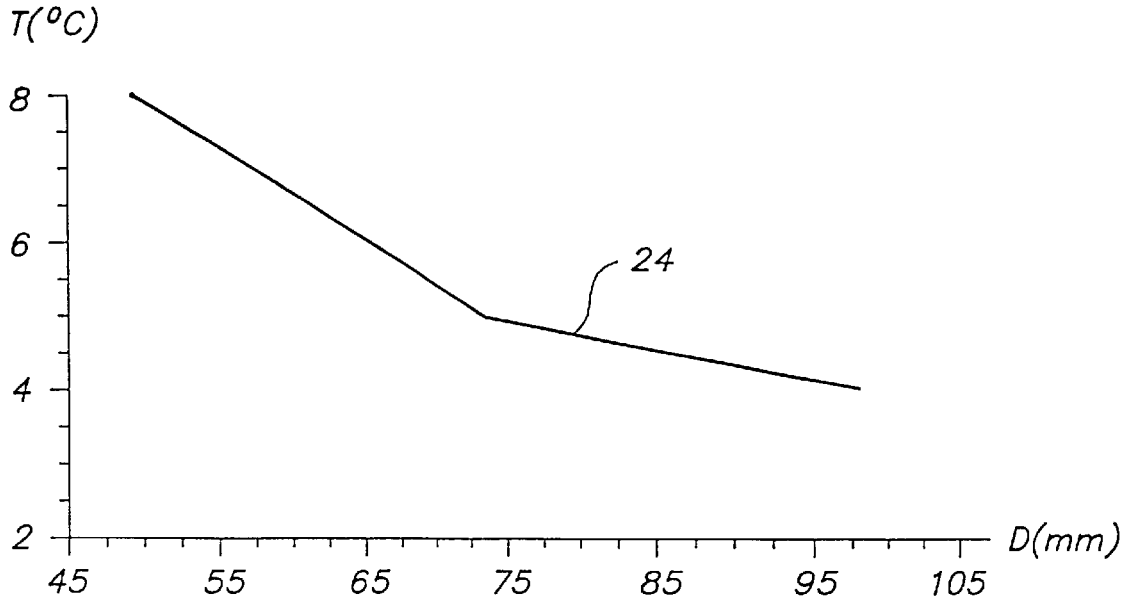
FIG. 3 shows the temperature ripple of a fixing roller in accordance with the present invention.

FIG. 3 shows the temperature ripple 24 measured on the surface of the fixing roller of fusing devices comprising roller pairs of different diameters D. The rollers of each roller pair had equal diameters, and one roller operated as a fixing roller whereas the other one was a pressure roller. The roller diameters were 49, 73.5 and 98 mm respectively.

Further characteristics of the rollers were as follows:

Thickness of resilient rubber covering: 3 mm

Covering filled silicone inner layer: 2.9 mm pure outer Viton layer: 0.1 mm

Nominal heating power: 20 W/cm

Fixing speed : 95 $mm.s^{-1}$

Throughput: 8.6 A3 sheets.$min^{-1}$
Paper: 100 g.$m^{-2}$

The figure shows that for roller diameters between 47 and 70 mm approximately, a 10 mm increase of roller diameter results in a reduction of the temperature ripple of approximately 1.25° C., whereas up from approximately 70 mm a 10 mm diameter increase leads to a reduction in temperature ripple smaller than 1° C. Thus a roller diameter of nearly 70 mm is in fact the minimum diameter which should be used for obtaining a reasonably low temperature ripple.

The nip length 1 of these three roller pairs amounted to 7 mm by appropriate adjustment of the roller pressure.

The following table illustrates the improvement which may be obtained by heat and pressure fusing by means of a fixing roller having a diameter larger than 70 mm, as compared with a roller having a smaller diameter. More in particular, the smaller roller measured 50 mm in diameter whereas the larger one measured 73.5 mm. Both simplex as well as twin-simplex (see our application mentioned in the introduction) images were fixed.

The fixing unit comprised roller pairs of equal diameters provided with a resilient covering. The roller pressure was adjusted so that a nip length l=9 mm was obtained, resulting in a fusing period of 115.0 msec. The temperature of the fusing roller was adjustable and was set in each case in such a way that a certain gloss was obtained. The gloss values G are unnumbered figures which were obtained by means of a common Minolta Multi-gloss meter, type 268.

The paper used was AGFA paper, type "ambient", with a weight of 100 g/$m^2$. Toner deposit amounted to 1 mg/$cm^2$. The amount of silicone oil as releasing agent for the fixing roller was 10 to 20 mg/A4 paper size.

Toner of type 1 had a viscosity of 418 Pa.s measured in a plate/plate rheometer at 120° C. and 100 rev.$s^{-1}$, whereas toner of type 2 had a viscosity of 302 Pa.s measured under the same conditions. Both toners were polyester-based toners, containing a 3% cyan pigment with a particle size of 8 $\mu$m.

Comparative table:

| | | Fusing temperature in ° C. | | | |
|---|---|---|---|---|---|
| | | roller diameter 50.0 mm | | roller diameter 73.5 mm | |
| | Gloss | simplex | twin-simplex | simplex | twin-simplex |
| Toner 1 | 15 | 162 | 181 | 135 | 158 |
| | 20 | 176 | 190 | 143 | 173 |
| | 25 | 188 | 198 | 151 | 184 |
| Toner 2 | 15 | 158 | 181 | 138 | 160 |
| | 20 | 168 | 188 | 144 | 169 |
| | 25 | 179 | 194 | 154 | 178 |

The table makes it clear that 73.5 mm fixing rollers allow the fusing temperature to be up to 30° C. lower, as compared with 50.0 mm rollers, for obtaining equal results as to gloss.

Furthermore, 73.5 mm rollers allow the fixing of twin-simplex images, whereas 50.0 mm rollers require a temperature (194° C.) which is no longer acceptable.

Further, it should be noted that the mentioned oil consumption of 10–20 mg/A4 was sufficient for obtaining a reliable release of the paper from the fusing roller(s), even for the 73.5 mm rollers where the smaller roller curvature offered a smaller contribution to the release of the paper sheets.

The use of a fusing device according to the present invention is particularly interesting for the fusing of electrophotographic colour images as mentioned in the introduction of this specification.

However, its use is even more interesting in the fusing of duplex colour images since the problem of surface temperature fluctuations of fixing rollers is even more stringent in such application. In this connection, we refer to our co-pending European patent application No. 96 20 3561 filed on Dec. 16, 1996.

Parts list:
10 fusing device
11 heater
12 fixing roller
13 pressure roller
14,15 roller tube
16,17 roller covering
18 roller nip
19 receptor support
20 toner image
21 temperature curve
23,24 temperature ripple
25 nip length

We claim:

1. A heat and pressure fusing device for fixing multilayer toner images to a receptor support, comprising a fixing roller and a pressing roller arranged for rotation in contact with each other, a heater for heating one of the rollers, each of the rollers having a resilient covering adapted to form a heating nip when the rollers are in contact with each other so as to fix the toner images to the receptor support, the thickness of the resilient covering of the fixing roller being at least 1.5 mm, the fixing roller having a peripheral surface, the peripheral surface having a temperature ripple during operation of the heat and pressure fusing device, the diameter of the fixing roller being larger than a specific diameter for which, when the specific diameter is increased by 10 mm, the reduction of the temperature ripple resulting from the 10 mm increase is less than 1° C., the temperature ripple being measured over one revolution of the fixing roller, and being measured at a fusing speed of 95 mm/second and for a receptor support of paper with a weight of 100 g/$m^2$ and a moisture content in the range of from 40% to 60% relative humidity.

2. A fusing device according to claim 1, wherein the impression of the fixing roller is less than 0.5 mm.

3. A fusing device according to claim 1, wherein the Shore hardness of the resilient covering is at least 40 Shore.

4. A fusing device according to claim 1, wherein the length l of the nip is at least 8 mm.

5. A fusing device according to claim 1, wherein the diameter of the pressing roller does not differ by more than 10% from that of the fixing roller.

6. A fusing device according to claim 1, wherein the pressing roller operates as a fixing roller for the fixing of duplex images.

7. A fusing device according to claim 1, wherein the resilient covering is silicone rubber.

8. A fusing device according to claim 1, which comprises means for treating the surface of the fixing roller to release a fixed support more easily.

9. A fusing device according to claim 1, which is arranged for the fixing of duplex color electrophotographic images.

10. A heat and pressure fusing device for fixing multilayer toner images to a receptor support, comprising a fixing roller and a pressing roller arranged for rotation in contact with each other and a heater for heating one of the rollers, each of the rollers having a resilient covering for forming a heating nip when the rollers are in contact with each other so as to fix the toner image to the receptor support, the thickness of the resilient covering of the fixing roller being at least 1.5 mm, and the diameter of the fixing roller being larger than 70 mm.

11. A heat and pressure fusing device according to claim 1, wherein the multilayer toner images on the receptor support have been produced by means of a toner comprising toner particles that:

have a viscosity $\eta$ such that 200 Pa·s<$\eta$<2000 Pa·s, the viscosity being measured in a plate/plate rheometer at 120° C. and at a velocity of 100 revolutions/second;

have a size in micrometers such that 6 $\mu$m<$d_{v50}$<12 $\mu$m, $d_{v50}$ being the average diameter of the toner particles expressed in $\mu$m; and comprise an amount of coloring agent such that depositing an amount TM of toner particles following the formula $$TM<0.8\times d_{v50}\times\rho$$

wherein TM is expressed in mg/cm$^2$, $d_{v50}$ is the average volume diameter of the toner particles expressed in cm, and p is the bulk density of the toner particles in mg/cm$^2$, yields maximum optical density.

* * * * *